US005805950A

United States Patent [19]

Inglese et al.

[11] Patent Number: 5,805,950

[45] Date of Patent: Sep. 8, 1998

[54] AUTOMATIC IDENTIFICATION OF ACCESSORIES IN A REPRODUCTION APPARATUS

[75] Inventors: Laureano L. Inglese, Rochester, N.Y.; Jochen H. Graeber, Muehlhausen, Germany

[73] Assignee: Eastman Kodak Company, Rochester, N.Y.

[21] Appl. No.: 771,744

[22] Filed: Dec. 20, 1996

[51] Int. Cl.[6] ..... G03G 15/00; G03G 21/00

[52] U.S. Cl. ..... 399/1; 358/296; 364/131; 395/114; 399/77

[58] Field of Search ..... 399/1, 9, 12, 13, 399/75, 76, 77, 78; 358/296, 401; 364/131, 148; 395/114

[56] References Cited

U.S. PATENT DOCUMENTS

| | | | |
|---|---|---|---|
| 4,987,447 | 1/1991 | Ohja | 399/84 |
| 5,164,769 | 11/1992 | Hashimoto et al. | 399/77 |
| 5,384,620 | 1/1995 | Ebner et al. | 399/1 |
| 5,461,704 | 10/1995 | Wakabayashi et al. | 395/114 |
| 5,504,669 | 4/1996 | Wakabayashi et al. | 364/131 |
| 5,559,606 | 9/1996 | Webster et al. | 358/296 |
| 5,585,891 | 12/1996 | Altrieth et al. | 399/1 X |
| 5,604,600 | 2/1997 | Webster | 358/296 |

*Primary Examiner*—Arthur T. Grimley
*Assistant Examiner*—Sophia S. Chen
*Attorney, Agent, or Firm*—Lawrence P. Kessler

[57] ABSTRACT

In a reproduction apparatus embodying a marking engine including a logic and control unit for controlling the operation of the reproduction apparatus and at least one accessory, such as a sorter, binder, stacker, folder, or the like, associated with the marking engine, a communication system for automatic identification of accessories associated with the marking engine. The communication system discloses a processor associated respectively with each accessory. The processor includes an identification of the associated accessory. A communication bus is interconnected between the logic and control unit of the marking engine and the processors of each respective accessory. A timing circuit, responsive to power up of the marking engine and associated accessories, automatically enables the processors of each respective accessory, in sequential order, to relay accessory identification provided by the respective processors, in such sequential order to the logic and control unit of the marking engine. The logic and control unit thereby receives an indication of which particular accessories are associated with the marking engine and in what order.

12 Claims, 2 Drawing Sheets

AUTOMATIC IDENTIFICATION OF ACCESSORIES IN A REPRODUCTION APPARATUS

BACKGROUND OF THE INVENTION

The present invention relates in general to reproduction apparatus including a number of accessories, and more particularly to automatic identification of accessories in a reproduction apparatus.

In typical commercial electrostatographic reproduction apparatus (such as copier/duplicators, printers, or the like), a latent image charge pattern is formed on a uniformly charged charge-retentive or photo-conductive member having dielectric characteristics (hereinafter referred to as the dielectric member). Pigmented marking particles are attracted to the latent image charge pattern to develop such image on the dielectric member. A receiver sheet is then brought into contact with the dielectric member, and an electric field applied to transfer the marking particle developed image to the receiver sheet from the dielectric member. After transfer, the receiver sheet bearing the transferred image is transported away from the dielectric member, and the image is fixed (fused) to the receiver sheet by heat and pressure to form a permanent reproduction thereon.

Reproduction apparatus are generally configured with a variety of output accessories for the receiver sheets bearing the respective transferred images. Such accessories include sorters, staplers, stackers, binders, or folders, for example. Accessories may be individually associated with a reproduction apparatus main frame marking engine, or may be grouped together in various combinations to enable the reproduction apparatus to perform particular more complex applications. The groupings may be permanent in nature, or may be selectively alterable to provide any desired arrangement dependent upon the desired particular application. With any particular arrangement, the reproduction apparatus main frame marking engine must know what accessories are associated therewith, and in what sequential order they occur, so as to enable the reproduction apparatus to be able to function in a manner to provide desired output in the proper format from the marking engine to the desired accessories.

In the prior art, such as shown for example in U.S. Pat. No. 5,559,606 (issued Sep. 24, 1996, in the names of Webster, et al), the controller for the main frame marking engine communicates with the processors of various accessories by a circuit. This circuit requires the marking engine controller to interrogate the accessory processors for each particular reproduction job to be performed by an overall reproduction apparatus (marking engine plus accessories). As such, until each reproduction job is completely programmed, and the accessory processors interrogated, the marking engine controller does not know if the overall reproduction apparatus is able to accomplish the desired reproduction of the particular job.

SUMMARY OF THE INVENTION

In view of the foregoing discussion, this invention is directed to a simplified communication system for automatic identification of accessories associated with a marking engine of a reproduction apparatus. The reproduction apparatus embodies the marking engine including a logic and control unit for controlling the operation of the reproduction apparatus and at least one accessory, such as a sorter, binder, stacker, folder, or the like, associated with the marking engine. The communication system as disclosed includes a processor associated respectively with each accessory. The processor includes an identification of the associated accessory. A communication bus is interconnected between the logic and control unit of the marking engine and the processors of each respective accessory. A communication timing circuit, responsive to power up of the marking engine and associated accessories, automatically enables the processors of each respective accessory, in sequential order, to relay accessory identification provided by the respective processors, in such sequential order to the logic and control unit of the marking engine. The logic and control unit thereby receives an indication of which particular accessories are associated with the marking engine and in what order.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
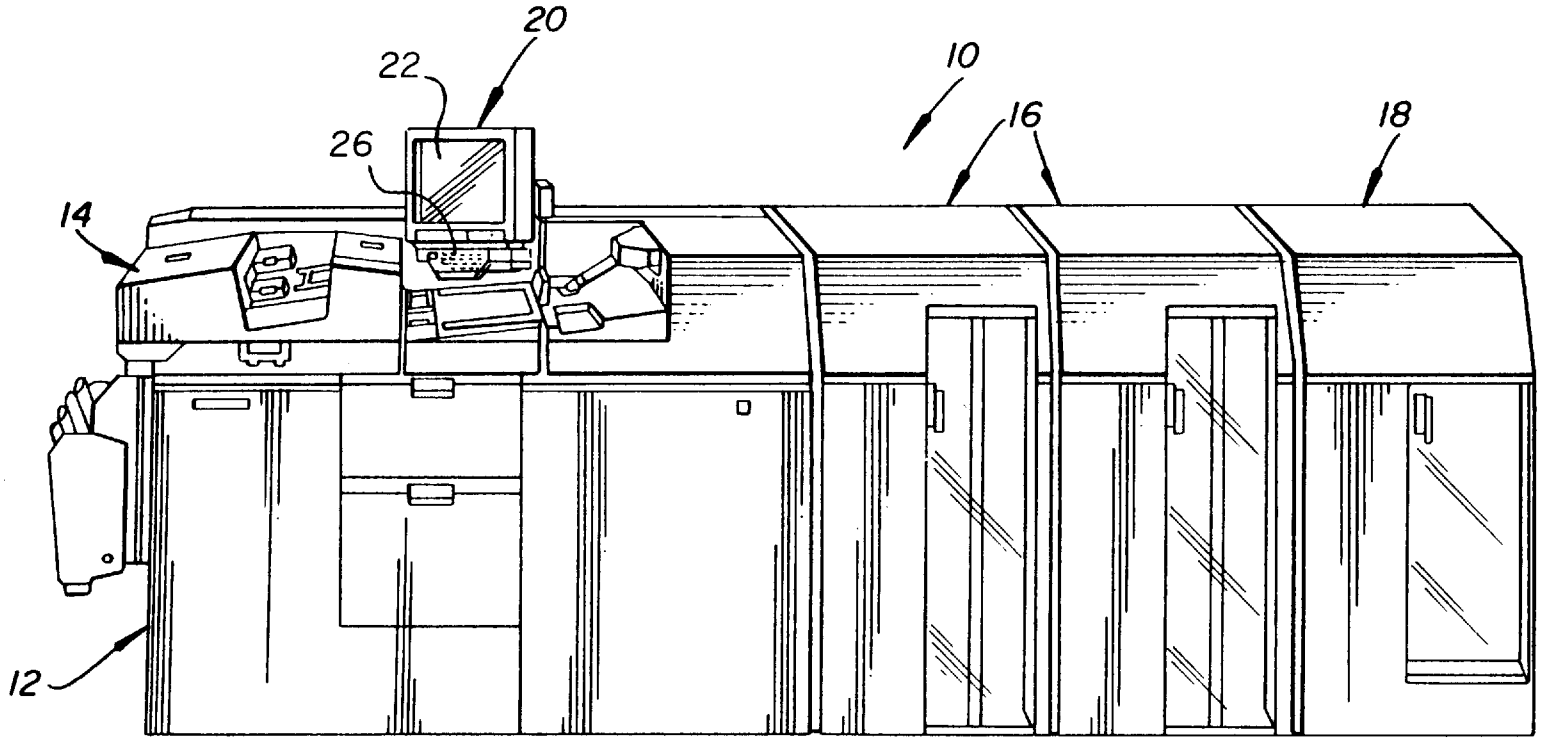
FIG. 1 is a front elevational view of a typical reproduction apparatus, with which the present invention is suitable for use.

Referring now to the accompanying drawings, a typical reproduction apparatus, designated generally by the numeral 10, is shown in FIG. 1. The reproduction apparatus 10 includes a reprographic marking engine 12 for reproducing information supplied thereto, such as by an original document sheet feeder 14, and a variety of accessories for facilitating the handling of reproduction output from the marking engine 12. In the apparatus 10 shown here, the accessories include a plurality of sorter towers 16, and a stacker/stapler 18. Of course, other accessories, such as binders or folders, are suitable for use with this invention. The sorter towers, and stacker/stapler are of any particular construction well known in the art of reproduction apparatus.

The marking engine 12 of the depicted reproduction apparatus 10 is, for example, an electrographic copier or printer, or a combination of the two. Generally speaking, a copier reproduces information from original documents by optical exposure of such documents, while a printer reproduces information from electronic signals representative of such information. Of course, other arrangements for reproduction apparatus, utilizing a different type of marking engine, or a different number or arrangement of accessories, are suitable for use with this invention.

In many arrangements for the reproduction apparatus 10, a plurality of different modes of user selectable operations or functions are possible. For example, duplex document booklets may be formed from simplex or duplex original information, or information to be copied may be edited to change its size, content, or orientation. In order to select desired operational modes from the plurality of different modes of operation, the reproduction apparatus includes a user communication interface designated generally by the numeral 20. Such user interface 20 includes, for example, a display 22 contained in a housing, a touch activated screen overlying the display 22, and a plurality of sets of manually activated keys 26. The user interface 20 is electrically coupled in any well known manner to a logic and control unit (LCU in FIG. 2) located within the housing of the reproduction apparatus 10. The logic and control unit LCU includes a microprocessor based controller electrically coupled to the marking engine 12 and accessories of the reproduction apparatus 10. Of course, the user interface 20 may alternatively include a stand alone logic and control unit which would then, in turn, be electrically coupled to the logic and control unit of the reproduction apparatus.

In order to control the reproduction apparatus 10, the controller of the logic and control unit LCU receives input signals from the user interface 20 and a plurality of sensors (not shown) associated in any well known manner with the reproduction apparatus marking engine 12 and accessories. Based on such signals and a program for the microprocessor, the logic and control unit produces appropriate signals to control the various operating devices within the reproduction apparatus. The production of a program for a number of commercially available microprocessors is a conventional skill well understood in the art, and do not form a part of this invention. The particular details of any such program would, of course, depend upon the architecture of the designated microprocessor.

As noted above, the accessories for the reproduction apparatus 10 can be of many different types, and in many different sequential orders. Furthermore, any particular type of accessory may be of any of a number of versions (i.e., may have updated software or hardware modifications). Therefore, to perform most efficiently, the reproduction apparatus should know the type of accessories, their sequential order, and their exact specifications. To accomplish this desired result and provide the reproduction apparatus with such knowledge, an automatic accessory identification circuit, designated generally by the numeral 30, is provided according to this invention.

Automatic accessory identification is a feature which allows the marking engine logic and control unit to automatically identify the number, specific types, and the sequential order of the accessories that are attached to the marking engine 12. This identification process is performed each time the marking engine 12 or an accessory is turned on. With this feature, accessories can be easily added, removed, rearranged, or updated. The marking engine logic and control unit will then automatically identify the new configuration the next time the marking engine 12 or an accessory is turned on.

Figure 2:
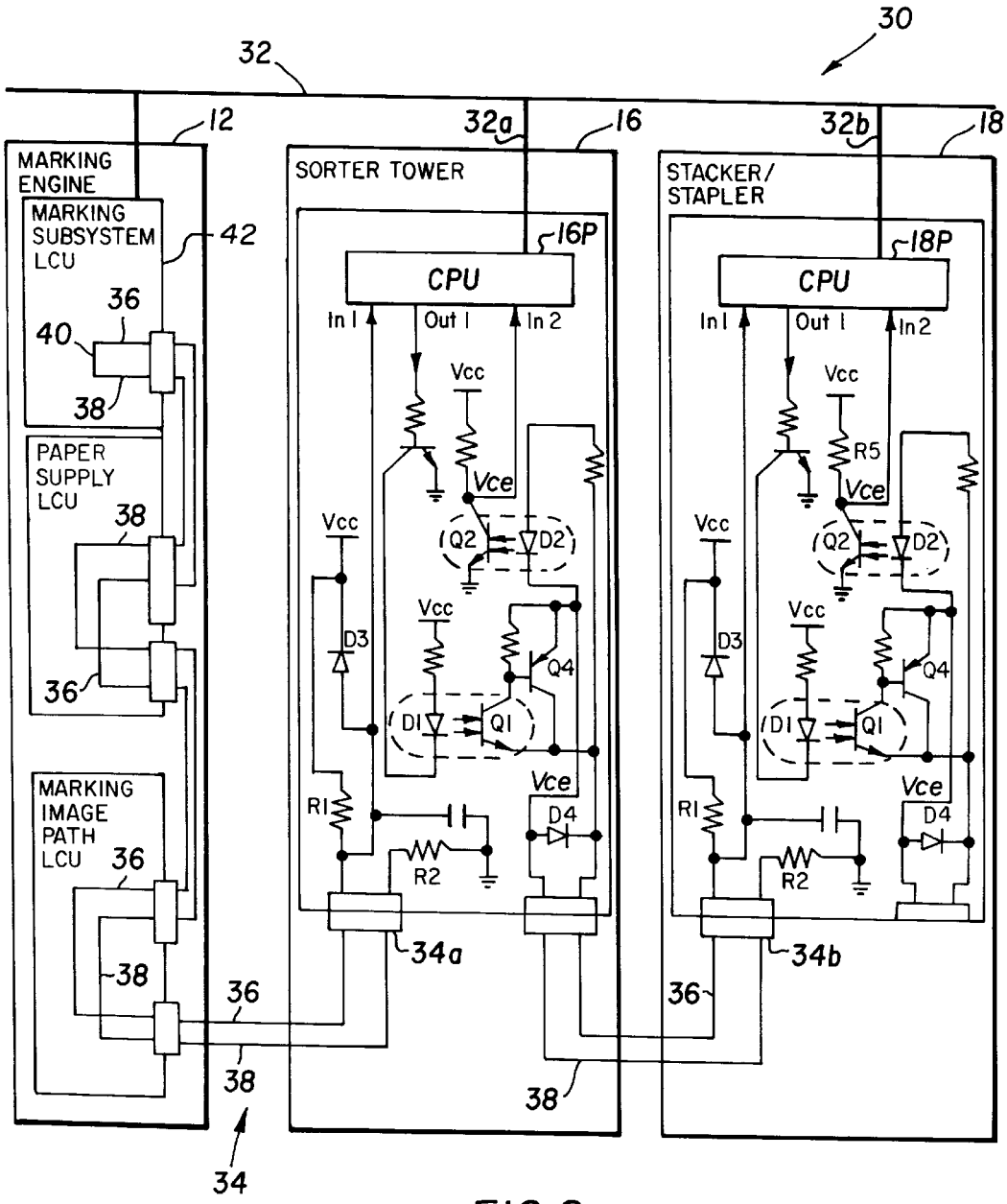
FIG. 2 is schematic diagram of the circuit for automatic identification of accessories in a reproduction apparatus, according to this invention.

The automatic accessory identification interface circuit 30 is shown in FIG. 2. To implement automatic accessory identification, the marking engine logic and control unit includes a marking system combining communication bus 32 and marking system timing bus 34. Each accessory (e.g., sorter tower 16, or stacker/stapler 18) is required to have a marking system communication bus interface 32*a*, 32*b*, and a marking system timing bus auto identification interface 34*a*, 34*b*. Two wires 36, 38 have been provided in the marking timing bus to support this feature. The feature is enabled with a "jumper" 40 within the marking engine logic and control unit 42 that connects one end of the two wires 36, 38 together.

Each accessory has a respective processor (16*p*, 18*p*, etc.), including a microprocessor based central processing unit (CPU). Upon power-up of the reproduction apparatus 10, the respective processors of each associated accessory sets the logic state of Out1 such that transistor Q1 is off, and senses the logic states of In1 and In2. The logic state at Out1 is used in combination with the logic state of In1 of the immediately subsequent accessory to grant permission to such subsequent accessory to begin its identification process for transmission to the logic and control unit LCU of the marking engine 12. A logic state "low" for In1 establishes a condition where an accessory will begin its identification process.

Conversely, a logic state "high" presents a condition where such accessory must continue to wait for the identification process condition to be established. The logic state of In2 is used to detect the presence of an immediately subsequent accessory. That is, a logic state "low" of In2 means that there is a subsequent accessory attached and a logic state "high" of In2 means that there is no subsequent accessory attached. Each accessory shall receive permission to begin its identification process by the preceding accessory. The accessory that is directly attached to the marking engine 12 shall receive permission from the marking engine logic and control unit LCU. These features allows each accessory to identify its type and sequential order to the marking engine logic and control unit LCU in a controlled manner and without operator intervention.

At power-up and after initialization of each of the accessories, only the logic state of In1 of the accessory attached directly to the marking engine 12 is "low". It is forced "low" by the jumper 40 in the marking engine logic and control unit LCU. The logic state of In1 of all the other accessories are forced "high" by resistance R1, since transistor Q1 is off in the immediately preceding accessory. This means that only the first accessory (immediate subsequent to the marking engine) has permission to begin its identification process. It does this by establishing communications with the marking engine logic and control unit LCU via the marking system communication bus 32. During the communication transaction, the particular accessory identifies its type and sequential order, and a marking system communication bus node address is assigned to it. All other accessories continue to monitor the status of the logic state of their respective In1, and wait for their turn to execute the identification process. Their respective marking communication bus interfaces remain disabled during this time. The marking system communication bus interface is disabled whenever the logic state of In1 is "high", and is enabled when the logic state at In1 is "low". An accessory shall not attempt communication to the marking engine logic and control unit LCU until it has received permission to begin its identification process.

After the first accessory (e.g., sorter tower 16)has completed its identification process and has predetermined that there is a subsequent accessory (e.g., stacker/stapler 18) attached thereto, the CPU 16*p* of the first accessory sets the logic state of Out1 such that transistor Q1 is turned on. This forces the logic state of In1 of the immediately subsequent accessory "low", and grants permission to such subsequent accessory to execute the identification process.

The first accessory has determined that a subsequent accessory was present when it sensed the status of the logic state of its In2. Resistance R1 of the subsequent accessory causes transistor Q2 to turn on, and forces a logic state "low" for In2. The CPU 16*p* of the first accessory reads the status of the logic state of In2 prior to turning on transistor Q1. If the subsequent accessory had not been present or was not powered-up, then transistor Q2 would be off and the logic state of In2 would be "high", thus indicating no subsequent active accessory is present. In this later instance, the CPU (16*p*) in the first accessory would not turn on transistor Q1. This process is repeated in sequential order for each accessory in the series until the last accessory has identified itself to the logic and control unit 42 of the marking engine 12.

Diode D1/transistor Q1 and diode D2/transistor Q2 are part of an opto-isolator (such as for example, Motorola CNY17GF1 or equivalent). Opto-isolators have been used here in the accessory automatic identification interface circuit 30 for the purpose of electrical isolation. This is beneficial for preventing ground loops, preventing conduction of high frequency noise, and for minimizing the effects of ground offsets. Diode D3 and diode D4 are for protecting against over voltage and negative transients. Transistor Q4 is for helping the opto-isolator drive the control signal logic state of In1 to the next accessory. For the logic state of In1, the "low" and "high" levels are determined by the value of Vcc, R1, R2 and Vce of transistor Q4 when it is turned on. For the logic state of In2, these levels are determined by Vcc and Vce of transistor Q2 when it is turned on.

The invention has been described in detail with particular reference to preferred embodiment thereof, but it will be understood that variations and modifications can be effected within the spirit and scope of the invention as set forth in the claims.

What is claimed is:

1. In a reproduction apparatus embodying a marking engine including a logic and control unit for controlling the operation of said reproduction apparatus and at least one accessory, such as a sorter, binder, stacker, folder, or the like, associated in a series with said marking engine, a communication system for automatic identification of accessories associated with said marking engine, said communication system comprising:

a processor associated respectively with each accessory, said processor including means for providing an identification of its associated accessory;

a communication bus interconnected between said logic and control unit of said marking engine and said processors of each respective accessory; and a timing circuit, responsive upon power up of said marking engine and associated accessories, for automatically electrically linking said processors of each respective accessory, in sequential order, to said logic and control unit of said marking engine to relay accessory identification provided by said respective processors, in such sequential order to said logic and control unit, whereby said logic and control unit receives an indication of which particular accessories are associated with said marking engine and in what order.

2. The communication system of claim 1 wherein said processor identification includes the status of its associated accessory.

3. The communication system of claim 1 wherein said processor identification includes the operational constraints of its associated accessory.

4. The communication system of claim 1 wherein said processor identification includes the status and operational constraints of its associated accessory.

5. The communication system of claim 4 wherein said processor includes a circuit having means for preventing communication of associated accessory identification until an immediate upstream accessory has completed its communication of associated accessory identification.

6. The communication system of claim 5 wherein said means for preventing communication of associated accessory identification includes a signal at a given logic state which prevents communication of accessory identification, and means responsive to a given change in logic state of said signal from an upstream accessory in said series of accessories to change the given logic state at said processor of a downstream accessory in said series of accessories.

7. The communication system of claim 6 wherein said given change in logic state of said signal from said upstream accessory results from said upstream accessory having completed its communication of associated accessory identification.

8. The communication system of claim 7 wherein said circuit includes an opto-isolator for the purpose of electrical isolation.

9. The communication system of claim 4 wherein said circuit includes means for indicating to an upstream accessory that there is an immediate downstream accessory.

10. The communication system of claim 9 wherein said indicating means includes a signal which is at a given logic state representing the existence of an accessory, and means for communicating such given logic state condition to an immediate upstream accessory.

11. The communication system of claim 10 wherein said circuit includes an opto-isolator for the purpose of electrical isolation.

12. The communication system of claim 4 wherein, with said series of accessories, said processor includes a circuit having means for indicating to an upstream accessory that there is an immediate downstream accessory, and means for preventing communication of associated accessory identification by a downstream accessory until an immediate upstream accessory has completed its communication of associated accessory identification.

* * * * *